US008267345B2

(12) United States Patent
Murata et al.

(10) Patent No.: US 8,267,345 B2
(45) Date of Patent: Sep. 18, 2012

(54) PAPER ROLL MOUNTING DEVICE

(75) Inventors: Yoshihiko Murata, Sodegaura (JP); Takumi Tanaka, Chiba (JP)

(73) Assignee: Kabushiki Kaisha Tokyo Kikai Seisakusho (JP)

( * ) Notice: Subject to any disclaimer, the term of this patent is extended or adjusted under 35 U.S.C. 154(b) by 0 days.

(21) Appl. No.: 13/116,322

(22) Filed: May 26, 2011

(65) Prior Publication Data

US 2012/0006931 A1 Jan. 12, 2012

(30) Foreign Application Priority Data

Jul. 6, 2010 (JP) ..... 2010-154079

(51) Int. Cl.
*B65H 19/00* (2006.01)
*B65H 67/00* (2006.01)

(52) U.S. Cl. ..... 242/559.2; 242/533.4

(58) Field of Classification Search ..... 242/596, 242/596.1, 596.4–596.6, 533, 533.2, 533.4, 242/533.5, 555.3, 555.5, 559.1–599.2, 534, 242/563, 558, 550, 520
See application file for complete search history.

(56) References Cited

U.S. PATENT DOCUMENTS 5,241,906 A * 9/1993 Kansaku ..... 101/228
6,328,249 B1 * 12/2001 Ogawa et al. ..... 242/559.2
6,616,086 B2 * 9/2003 Nakamura et al. ..... 242/559.2
7,905,445 B2 * 3/2011 Kroger ..... 242/596.5
2002/0130214 A1 * 9/2002 Nakamura et al. ..... 242/559.2

FOREIGN PATENT DOCUMENTS

JP 06-024608 2/1994
JP 2000-309454 11/2000

* cited by examiner

*Primary Examiner* — Michael Mansen
*Assistant Examiner* — Juan Campos, Jr.
(74) *Attorney, Agent, or Firm* — Clark Hill PLC

(57) ABSTRACT

A paper roll mounting device, configured to enable a paper roll to be supported by a paper roll supporting means provided to each arm of pairs of arms by rotary-driving a female screw member to individually move each arm in a direction parallel to a rotating shaft, is provided with: a female screw rotation amount signal output means provided to output a rotation amount signal corresponding to a rotation amount of the respective female screw member, individually on a female screw member basis, in response to rotation of the female screw member; and an arm stop position control unit configured to enable setting of a reference position for each of the arms, and, when changing a position of each of the arms in an axis direction of the rotating shaft, to enable input designation of a stop position of each of the arms, and to detect a current position of the arms with respect to the reference position by calculating a movement amount of the arms based on the rotation amount signal, and thereby move each of the arms to the designated stop position and cause each of the arms to stop at the designated stop position. This makes each of the arms stoppable at a desired position in the direction parallel to the rotating shaft.

1 Claim, 5 Drawing Sheets

PAPER ROLL MOUNTING DEVICE

CROSS-REFERENCE TO RELATED APPLICATIONS

The present application relates to subject matter contained in Japanese Patent Application No. 2010-154079, filed on Jul. 6, 2010, all of which is expressly incorporated herein by reference in its entirety.

BACKGROUND OF THE INVENTION

1. Field of the Invention

The present invention relates to a paper roll mounting device, in particular, to a paper roll mounting device configured to enable input designation of a stop position of an arm whenever a position of the arm is changed, to enable detection of a current position of the arm at all times and to enable stopping of the arm at a designated position.

2. Description of the Related Art

In recent years, a rotary press is required to be capable of processing paper rolls of different widths for improvement in operational efficiency and productivity of the rotary press.

A well-known mounting device for a paper roll in a paper feeder of a conventional rotary press for processing paper rolls of different paper width has: a rack provided to a rotating shaft along an axis direction of the rotating shaft, the rotating shaft being supported by two frames to left and right; arms provided to this rotating shaft to be movable in the axis direction of the rotating shaft; and, furthermore, a pinion rotatably provided to these arms, the pinion being configured to engage with the rack (refer to below-listed Patent Document 1, for example). In the conventional rotary press described in Patent Document 1, each of the pinions is rotated manually to change the position of the arms in a direction parallel to the rotating shaft.

On the other hand, proposed as a technology to eliminate such troublesome manual operation is the technology disclosed in below-listed Patent Document 2. Patent Document 2 proposes a paper roll mounting device in which: a mounting arm pivot (hereinafter described as 'pivot') corresponding to the rotating shaft is rotatably provided to two frames that face each other at a distance; this rotating shaft is provided with a plurality of pairs of arms such that the arms are individually movable in an axis direction of the rotating shaft and such that each of the pairs of arms face each other in the axis direction; a male screw member is provided to the rotating shaft parallel to the rotating shaft so as to penetrate both arms of a pair of the arms that face each other in the axis direction; and a female screw member rotary-driven by a driving motor is thread-connected to the male screw member and provided to each of the arms rotatably and coupled in the axis direction to the arms. Furthermore, this paper roll mounting device is configured to enable a stop position of a plurality of arms along the axis direction of the rotating shaft to be previously defined, to enable a detection block disposed on the rotating shaft to be detected by a proximity sensor disposed in the arm, and to detect when the arm has reached the previously defined stop position, and stop the arm at the previously defined stop position by a detection signal when the arm has reached the previously defined stop position.

[Patent Document 1] JP 06-24608 A

[Patent Document 2] JP 2000-309454 A

SUMMARY OF THE INVENTION

The paper roll mounting device described in above-listed Patent Document 2 is configured having the detection block provided to the rotating shaft and can thus be easily applied to the case where a width dimension of a paper roll to be changed differs greatly, as in the case of printing a newspaper by a newspaper printing rotary press capable of using a paper roll having a four-newspaper-page width dimension, a paper roll having a three-newspaper-page width dimension, a paper roll having a two-newspaper-page width dimension, and a paper roll having a one-newspaper-page width dimension.

However, in current rotary presses (for example, rotary presses for commercial printing, and so on) which require that the difference in width dimension of a paper roll to be changed is a maximum of the order of 200 millimeters or more, and that paper rolls of a large number of differing width dimensions within this range can be processed by the same rotary press, many stop positions of the arm must be set that have a difference in dimension of less than several tens of millimeters. Hence, there are problems such as that securing space to dispose the detection blocks is extremely difficult and that, even if the detection blocks can be disposed, adjustment of the proximity sensor with respect to each of the detection blocks must be performed accurately to enable stopping of the arm to be performed precisely, therefore adjustment man-hours increase greatly due to the high level of skill required in assembly. Consequently, application of the mounting device for paper rolls described in Patent Document 2 is in fact impossible. Accordingly, in the relevant technical field, an innovation for solving these problems is sought.

The present invention was made to meet the above-mentioned requirements, and an object of the present invention is to provide a paper roll mounting device configured to enable input designation of a stop position of an arm whenever a position of the arm is changed, to enable detection of a current position of the arm at all times and to enable stopping of the arm at a designated position.

A paper roll mounting device in accordance with the present invention comprises: a rotating shaft rotatably supported by two frames that face each other at a distance; a plurality of pairs of arms attached to the rotating shaft so as to face each other in an axis direction of the rotating shaft and configured to be individually movable in the axis direction; paper roll supporting means provided to an extremity of each of the arms so as to face each other in the axis direction; a male screw member supported parallel to the rotating shaft by the rotating shaft, and configured to penetrate both arms of one of the pairs of arms that face each other in the axis direction; a female screw member provided rotatably to each of the facing arms and coupled to the rotating shaft and configured to be thread-connected to the male screw member; and a female screw driving motor configured to individually rotary-drive the female screw member, wherein the paper roll mounting device, configured to enable a paper roll to be supported by the paper roll supporting means provided to each of the arms of one of the pairs of arms by rotary-driving the female screw member to individually move each of the arms in a direction parallel to the rotating shaft, is provided with: a female screw rotation amount signal output means provided to output a rotation amount signal corresponding to a rotation amount of the respective female screw member, individually on a female screw member basis, in response to rotation of the female screw member; and an arm stop position control unit configured to enable setting of a reference position for each of the arms, and, when changing a position of each of the arms in the axis direction of the rotating shaft, to enable input designation of a stop position of each of the arms, and to detect a current position of the arms with respect to the reference position by calculating a movement amount of the arms based on the rotation amount signal, and thereby move each of the arms to the designated stop position and cause each of the arms to stop at the designated stop position, thus making each of the arms stoppable at a desired position in the direction parallel to the rotating shaft.

The paper roll mounting device in accordance with the present invention enables an arm for mounting a paper roll subject to processing to be stopped at a desired stop position corresponding to a width dimension of the paper roll, and, moreover, enables paper rolls of various width dimensions and having small differences in width dimension to be processed by the same rotary press. The paper roll mounting device in accordance with the present invention thus enables operational efficiency and productivity in said rotary press to be significantly improved.

DETAILED DESCRIPTION OF THE INVENTION

Preferred embodiments for carrying out the present invention are described below with reference to the drawings. The following embodiments are not intended to limit the inventions set forth in the claims, and the combinations of features described in the embodiments are not all necessarily indispensable for the means for solving the problem provided by the invention.

Figure 1:
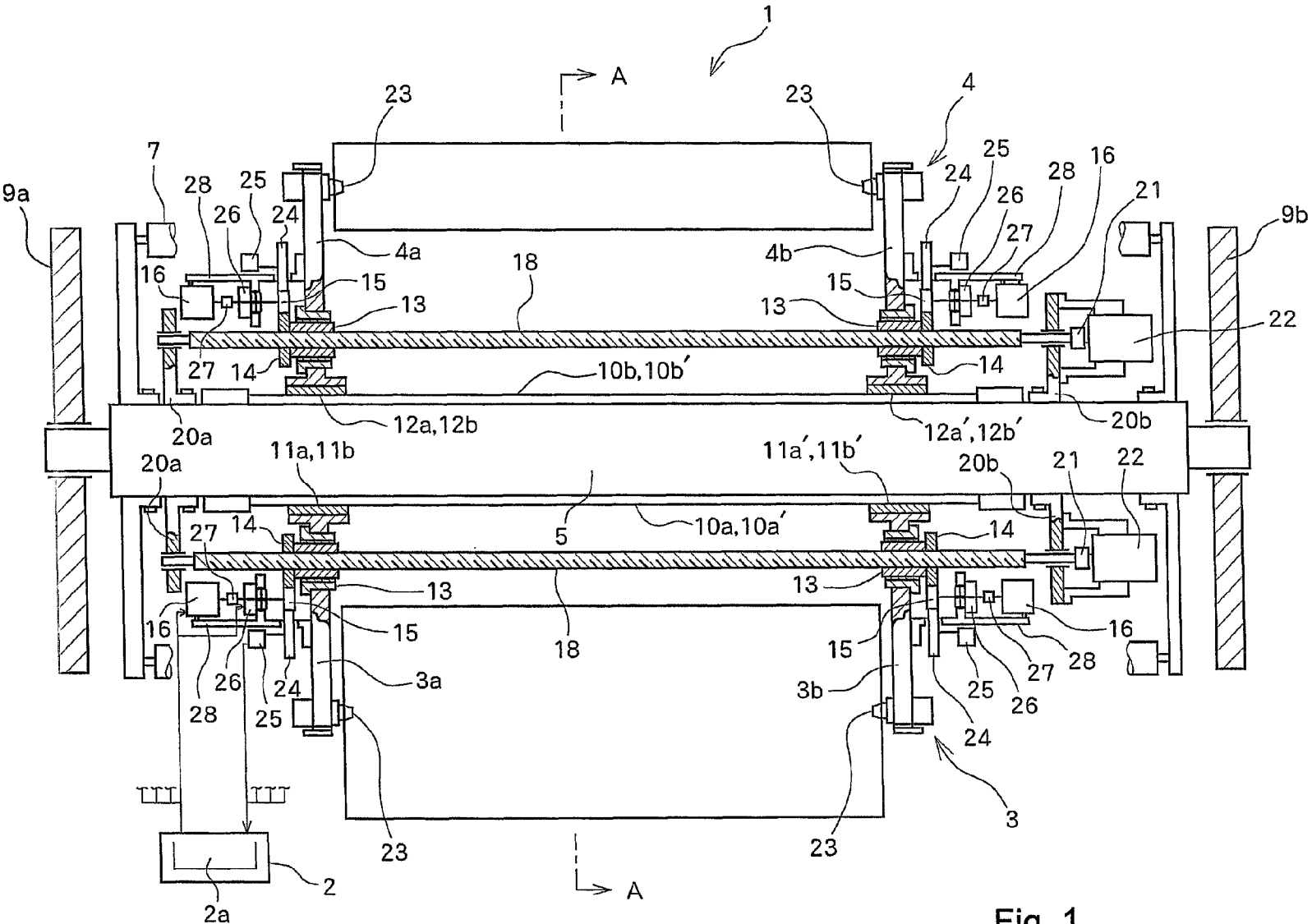
FIG. 1 is a partially broken cross-sectional view of a schematic configuration of a paper roll mounting device in accordance with the present embodiment.
Figure 2:
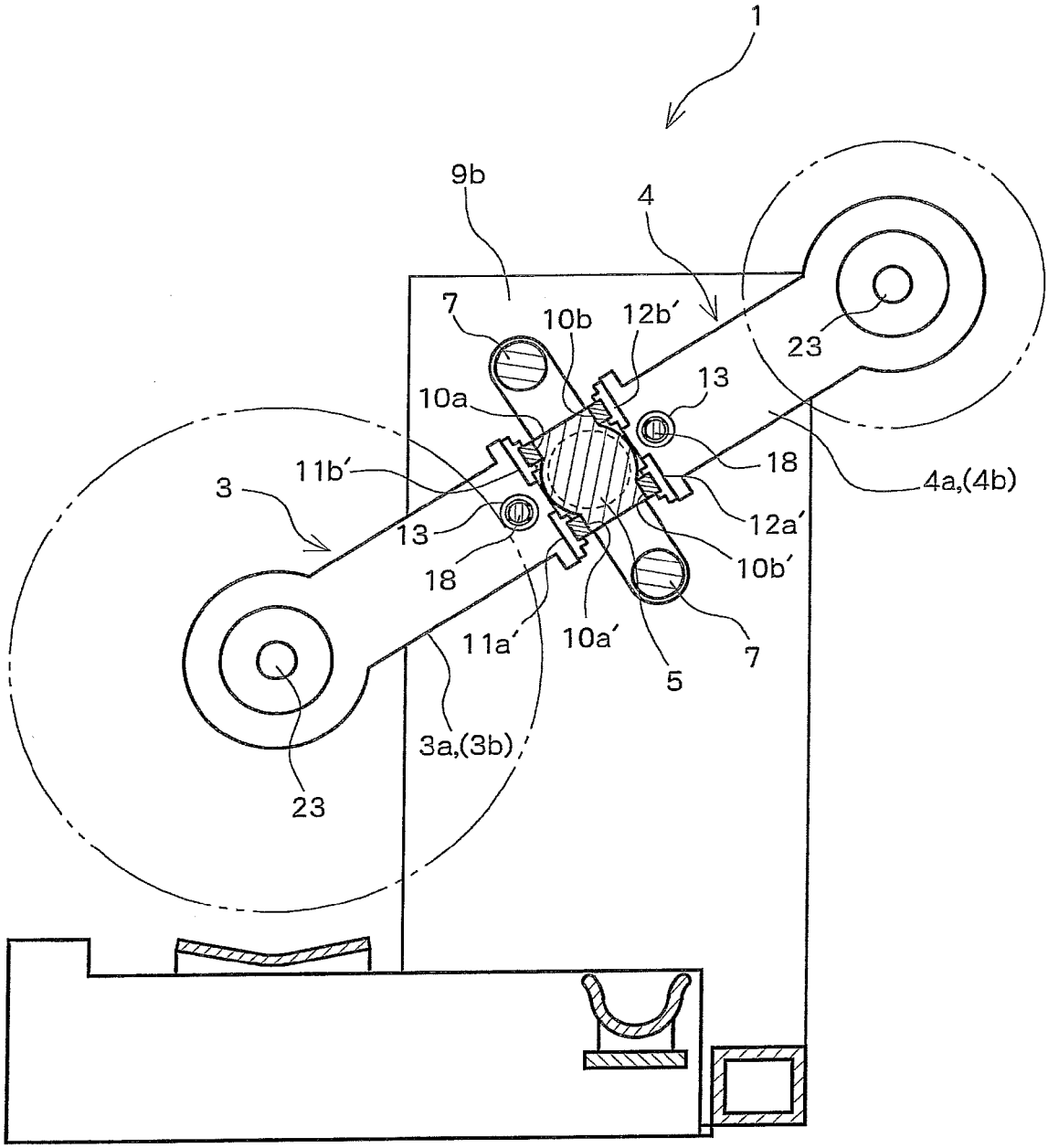
FIG. 2 is a cross-sectional view schematically showing a cross-sectional structure taken along the line A-A of FIG. 1.

FIG. 1 is a partially broken cross-sectional view of a schematic configuration of a paper roll mounting device 1 in accordance with the present embodiment. FIG. 2 is a cross-sectional view schematically showing a cross-sectional structure taken along the line A-A in FIG. 1.

FIGS. 1 and 2 show: a paper roll mounting device 1; an arm stop position control unit 2; an input means 2*a*; frames 9*a*, 9*b*; a rotating shaft 5; support arm pairs 3, 4 configured respectively from pairs of arms 3*a*, 3*b* or 4*a*, 4*b* that face each other in an axis direction of the rotating shaft 5; rails 10*a*, 10*b*, 10*a*', 10*b*'; and moving plates 11*a*, 11*b*, 11*a*', 11*b*' and 12*a*, 12*b*, 12*a*', 12*b*'. FIGS. 1 and 2 also show: a male screw member 18; a female screw member 13; a driven gear 14; a drive gear 15; a female screw driving motor 16; a gear 24; a female screw rotation amount signal output means 25; a brake 26; and a torque limiter 27. The rotating shaft 5 has its two ends rotatably supported by the frames 9*a*, 9*b*, respectively, and is coupled to a rotary-driving means not shown. A cross-sectional shape of a portion of the rotating shaft 5 inward of the two frames 9*a*, 9*b* is configured to be substantially square. Moreover, each side of both sides of the rotating shaft 5 in a direction perpendicular to an axis of the rotating shaft 5 has pairs of the rails 10*a*, 10*a*', 10*b*, 10*b*' provided in parallel in the axis direction.

Movably attached to and guided by the rails 10*a*, 10*a*', 10*b*, 10*b*' on each side are, respectively, pairs of the moving plates 11*a*, 11*b*, 11*a*', 11*b*' and 12*a*, 12*b*, 12*a*', 12*b*' separated in the axis direction. In addition, a base end section of the arm 3*a* which is one of the arms configuring the support arm pair 3 is attached to the moving plates 11*a*, 11*b* on one axis-perpendicular side of the rotating shaft 5 and to one side in the axis direction of the rotating shaft 5, and a base end section of the arm 3*b* which is the other of the arms configuring the support arm pair 3 is attached to the moving plates 11*a*', 11*b*' on the one axis-perpendicular side of the rotating shaft 5 and to the other side in the axis direction of the rotating shaft 5. And, a base end section of the arm 4*a* which is one of the arms configuring the support arm pair 4 is attached to the moving plates 12*a*, 12*b* on the other axis-perpendicular side of the rotating shaft 5 and to the one side in the axis direction of the rotating shaft 5, and a base end section of the arm 4*b* which is the other of the arms configuring the support arm pair 4 is attached to the moving plates 12*a*', 12*b*' on the other axis-perpendicular side of the rotating shaft 5 and to the other side in the axis direction of the rotating shaft 5.

Moreover, each of the support arm pairs 3, 4 is provided with holes penetrating facing pairs of the arms 3*a*, 3*b* and 4*a*, 4*b* in the axis direction of the rotating shaft 5 at positions of identical distance from a shaft center of the rotating shaft 5. Fitted to each of these holes rotatably and so as not to move in the axis direction is the female screw member 13. In addition, the male screw members 18, 18 are rotatably provided, individually, in parallel to the rotating shaft 5, via brackets 20*a*, 20*b*, to each of a surface of the rotating shaft 5 provided with the rails 10*a*, 10*a*' and a surface of the rotating shaft 5 provided with the rails 10*b*, 10*b*', so as to be thread-connected to, respectively, the female screw members 13, 13 provided to the arms 3*a*, 3*b* or arms 4*a*, 4*b*, and so as to penetrate the arms 3*a*, 3*b* or arms 4*a*, 4*b*. Moreover, one end of each of these male screw members 18, 18 is coupled via a torque limiter 21 to an output shaft of a male screw driving motor 22 supported via a motor bracket and the bracket 20*b*.

Furthermore, a paper roll supporting means is provided to a free end side of each of the arms 3*a*, 3*b* and 4*a*, 4*b* of each of the support arm pairs 3, 4 at a position of identical distance from the shaft center of the rotating shaft 5, the paper roll supporting means projecting a support 23 on its respective facing inner sides.

Meanwhile, the driven gear 14 is attached to the female screw member 13 to be rotatable in an integrated manner with the female screw member 13. Moreover, the female screw driving motor 16 is provided via the bracket 28 to each of the arms 3*a*, 3*b* and 4*a*, 4*b*, and an output shaft of this female screw driving motor 16 is coupled via the torque limiter 27 to an intermediate shaft. Attached to this intermediate shaft is the drive gear 15 which engages with the driven gear 14. This drive gear 15 is provided so as to engage also with the gear 24 that is attached to an input shaft of the female screw rotation amount signal output means 25 (hereinafter described as "absolute rotary encoder 25"), the absolute rotary encoder 25 being attached, directly or via some kind of bracket, to the bracket 28. In addition, the intermediate shaft is provided with the brake 26. Further, the female screw driving motor 16, the absolute rotary encoder 25, and the brake 26 are each linked via a network connection to the arm stop position control unit 2.

Figure 3:
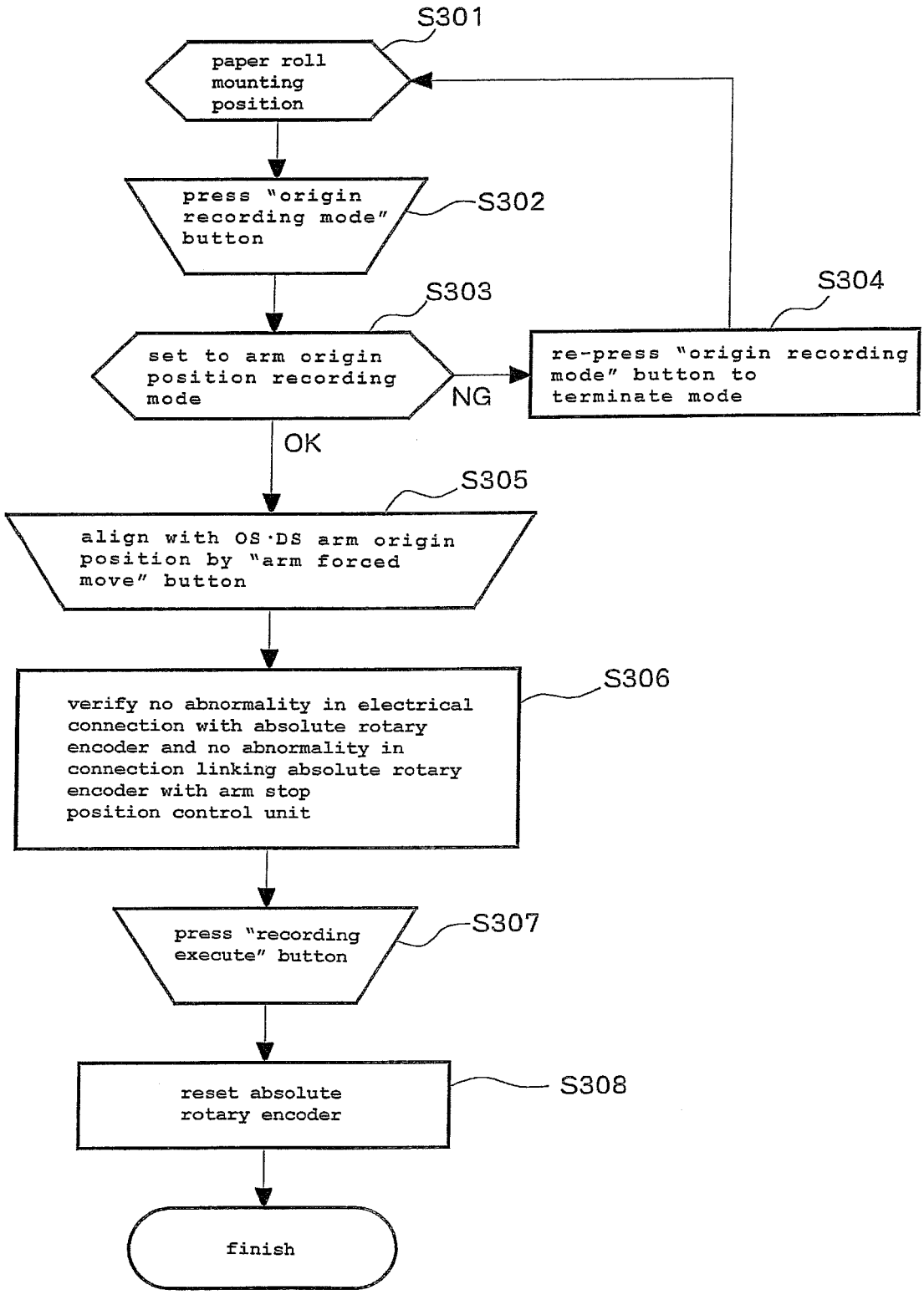
FIG. 3 is a flowchart showing processes in an operation for paper width change, particularly, processes for arm origin position recording.
Figure 4:
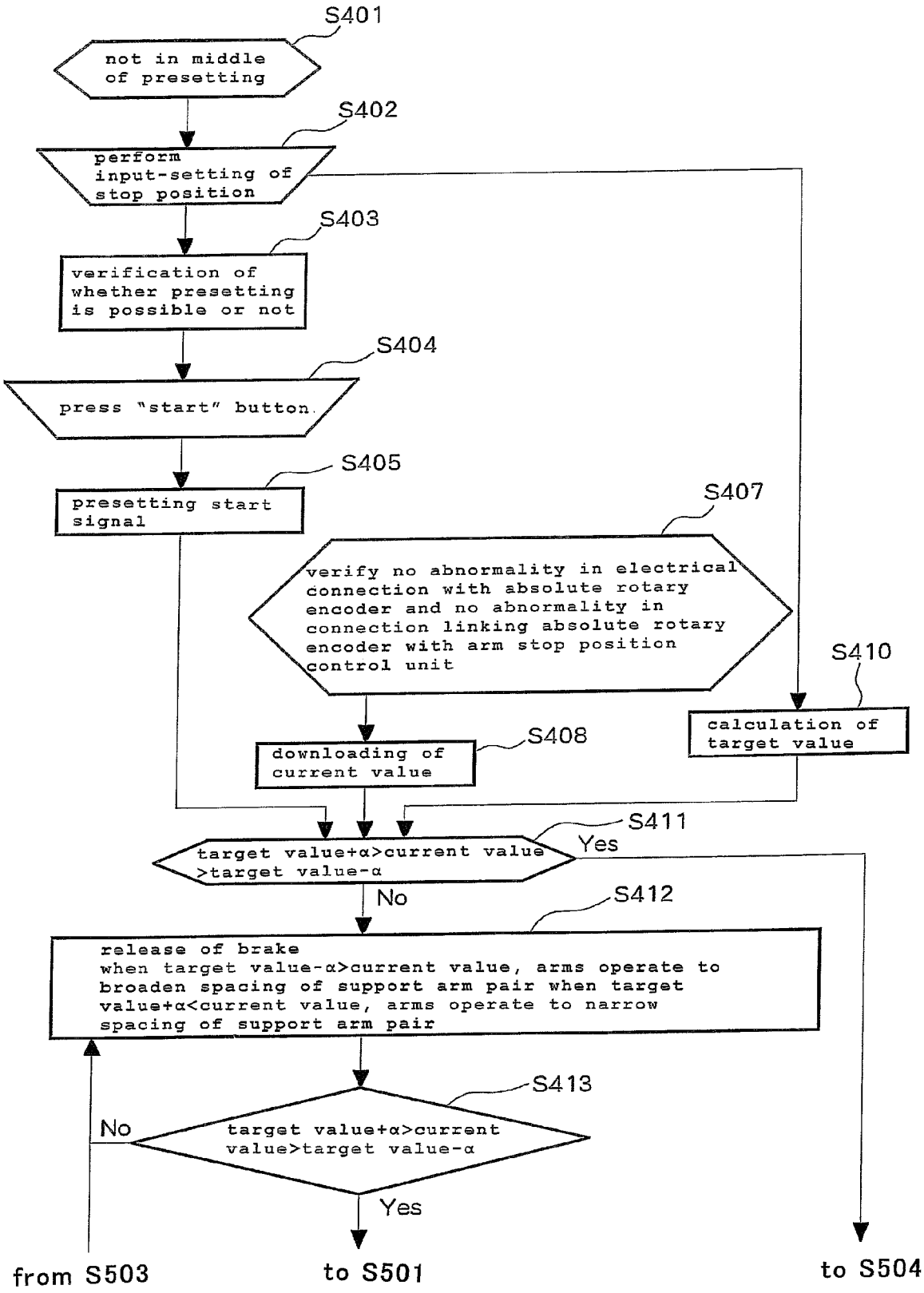
FIG. 4 is a flowchart showing processes in an operation for paper width change, particularly, processes for arm position setting.
Figure 5:
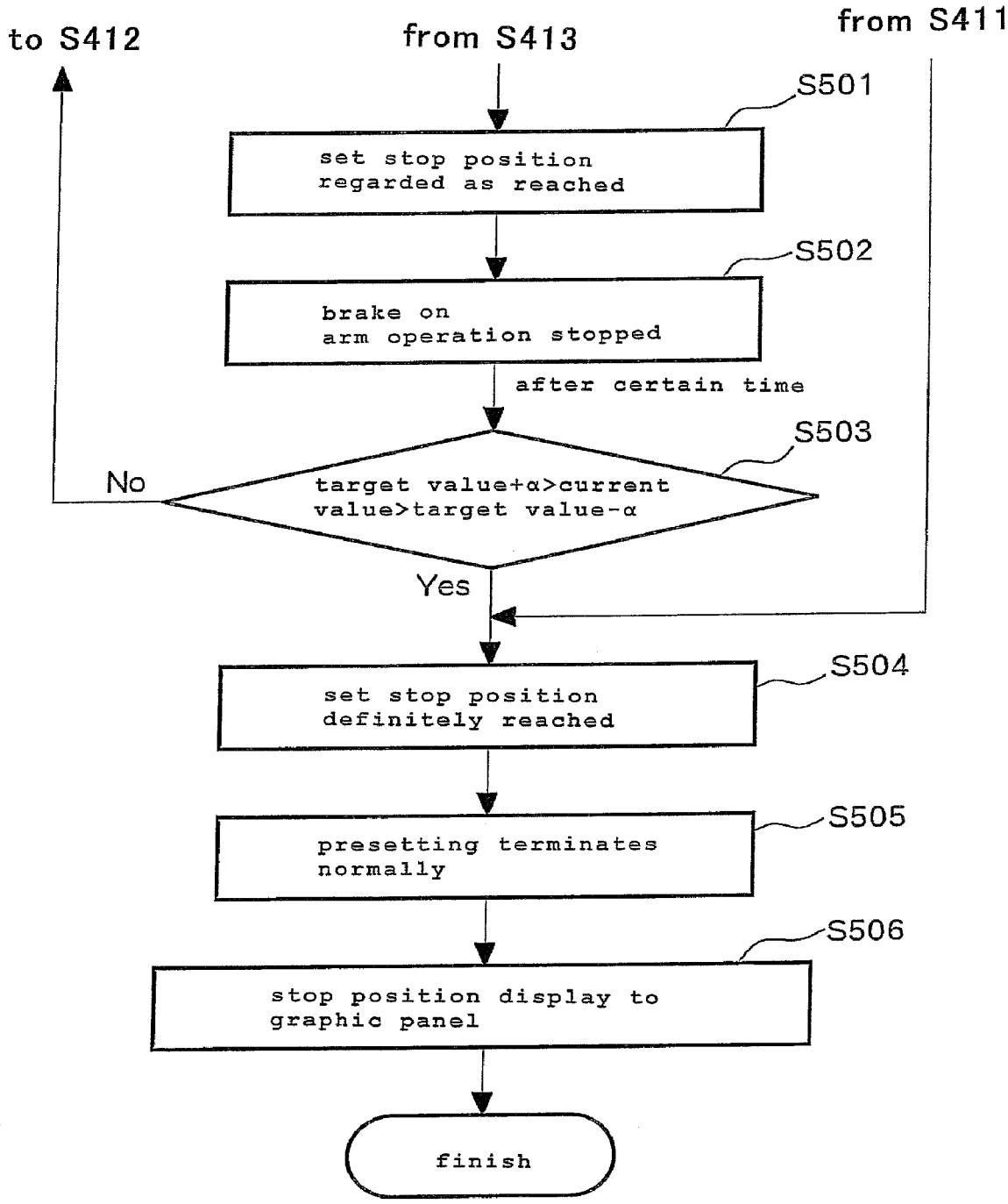
FIG. 5 is a flowchart showing processes in an operation for paper width change, particularly, processes for arm position setting.

Next, operation of the paper roll mounting device 1 configured in the above-described manner is described with reference to the flowcharts in FIGS. 3 to 5.

First, arm origin position recording is described with reference to FIG. 3. This arm origin position recording is implemented when said paper roll mounting device 1 is assembled, when initialization is required accompanying component replacement, or when there is a possibility that a deviation in the recorded origin position has occurred due to some kind of event.

After a main power supply is switched on, the rotating shaft 5 is rotated by the rotary-driving means not shown, such that the support arm pair 3 or 4 to undergo arm origin position recording has its position in a radial direction from the center of the rotating shaft 5 matching a paper roll mounting position (step S301). Note that step S301 is implemented when adopting a configuration in which the arms 3*a*, 3*b* or 4*a*, 4*b* positioned at the paper roll mounting position are subject to arm origin position recording. However, in place of step S301, a configuration may also be adopted in which the arms 3*a*, 3*b* or 4*a*, 4*b* to undergo arm origin position recording can be designated by the input means 2*a* (hereinafter described as "operating graphic panel 2*a*") of the arm stop position control unit 2.

Subsequently, a "origin recording mode" button of the operating graphic panel 2*a* is pressed to set the arm stop position control unit 2 to arm origin position recording mode (steps S302 and S303). After setting to origin recording mode, an "arm forced move" button of the operating graphic panel 2*a* is pressed, whereby the female screw driving motor 16 associated with the arms 3*a*, 3*b* or 4*a*, 4*b* of the support arm pair 3 or 4 at the paper roll mounting position is activated and the drive gear 15 attached to the output shaft of the female screw driving motor 16 is rotated. This rotation of the drive gear 15 causes the driven gear 14 and the gear 24 which are engaged with the drive gear 15 to be rotated. Rotation of the driven gear 14 causes the female screw member 13 which is configured in an integrated manner with the driven gear 14 to be rotated, and to be moved by thread advancement along the male screw member 18 to which the female screw member 13 is thread-connected. As a result, one of the arms 3*a*, 3*b*, 4*a*, 4*b* to which the female screw member 13 is fitted rotatably and so as not to move in the axis direction is moved along the male screw member 18 together with the female screw member 13. Said operation is performed individually for each of the arms 3*a*, 3*b*, 4*a*, 4*b*, whereby each of the arms 3*a*, 3*b*, 4*a*, 4*b* is accurately aligned with and stopped at a certain arm origin position in the axis direction of the rotating shaft 5 set previously for each of the arms 3*a*, 3*b*, 4*a*, 4*b* (step S305). Note that the accurate alignment with said certain arm origin position is performed by, for example, accurately measuring the stop position of each of the arms 3*a*, 3*b*, 4*a*, 4*b* by an appropriate measuring instrument such that the stop position matches the arm origin position and thereby correctly set the stop position of each of the arms 3*a*, 3*b*, 4*a*, 4*b*, or by correctly matching to an accurately measured and marked stop position to thereby set the stop position.

After each of the arms 3*a*, 3*b*, 4*a*, 4*b* is stopped at a certain arm origin position, absence of any abnormality in electrical connection with the absolute rotary encoder 25 and absence of any abnormality in the connection linking the absolute rotary encoder 25 with the arm stop position control unit 2 are automatically verified (step S306), and, when an abnormality is found, an indication to that effect is output by an appropriate means.

Subsequently, a "recording execute" button of the operating graphic panel 2*a* is pressed (step S307), and a rotational phase value of the input shaft of each of the absolute rotary encoders 25 associated with each of the arms 3*a*, 3*b*, 4*a*, 4*b* is reset to "zero" (step S308). That is, the rotational phase value of the input shaft of the absolute rotary encoder 25 changes accompanying activation of the female screw driving motor 16 when said female screw driving motor 16 is activated to move each of the arms 3*a*, 3*b*, 4*a*, 4*b* along the male screw member 18, and the position at which the rotational phase value of the input shaft of the absolute rotary encoder 25 becomes "zero" is recorded as the arm origin position of each of the arms 3*a*, 3*b*, 4*a*, 4*b*. On completion of step S308, the arm origin position recording mode is automatically terminated.

Note that, when an abnormality is found in step S306, step S308 becomes unexecutable. Moreover, terminating the arm origin position recording mode before reaching step 308 after the paper roll mounting device 1 is set to the arm origin position recording mode is enabled by re-pressing the "origin recording mode" button of the operating graphic panel 2*a* (step S304).

Next, desired position setting (hereinafter described as "presetting") which is executed when stopping the support arm pair 3 or 4 at a desired position in the axis direction of the rotating shaft 5 is described with reference to FIGS. 4 and 5. Note that the processing flow described in FIGS. 4 and 5 is continuous, and that the two figures show a single flowchart.

After the main power supply is switched on and the arm stop position control unit 2 attains a stable state, and when absence of any abnormality in electrical connection with the absolute rotary encoder 25 and absence of any abnormality in the connection linking the absolute rotary encoder 25 with the arm stop position control unit 2 are verified (step S407), the rotational phase value at that time of the input shaft of the absolute rotary encoders 25 associated with each of the arms 3*a*, 3*b* or 4*a*, 4*b* subject to presetting, that is, data related to the position at that time of each of the arms 3*a*, 3*b* or 4*a*, 4*b* subject to presetting is downloaded to the arm stop position control unit 2 (step S408).

Moreover, after the main power supply is switched on and the arm stop position control unit 2 attains a stable state, and before starting the presetting, the support arm pairs 3, 4 are visually observed to verify that the position in the radial direction from the center of the rotating shaft 5 of the support arm pair 3 or 4 to undergo presetting is at the paper roll mounting position, and the screen display of the graphic panel 2*a* is viewed to verify that the relevant support arm pair 3 or 4 is not currently in the middle of paper width presetting (step S401). At this time, if the support arm pair 3 or 4 to undergo presetting is not at the above-mentioned paper roll mounting position, the rotating shaft 5 is rotated by the aforementioned rotary-driving means not shown to set the support arm pair 3 or 4 to the paper roll mounting position.

After verifying that the support arm pair 3 or 4 to undergo presetting is not in the middle of presetting and that said support arm pair 3 or 4 is at the paper roll mounting position, input setting of the certain stop position of each of the arms 3*a*, 3*b* or 4*a*, 4*b* in the axis direction of the rotating shaft 5 previously set to correspond to the width of paper roll to be processed is performed by input buttons of the graphic panel 2*a* (step S402). Note that the arm stop position control unit 2 may have a configuration which enables setting of the stop position by a selection operation of push buttons in the graphic panel 2*a* that specify the width dimension of the paper roll and are previously set to associate the width dimension of the paper roll and the stop position, may have a configuration which enables setting of the stop position by numerical input by an operation of a numeric keypad in the graphic panel 2*a*, and may have a configuration which enables setting of the stop position by both of these push button and numeric keypad operations; and that when the arm stop position control unit 2 has the configuration which enables setting of the stop position by a selection operation of push buttons in the graphic panel 2*a* that specify the width dimension of the paper roll and are previously set to associate the width dimension of the paper roll and the stop position, setting of the push buttons specifying the width dimension of the paper roll to associate the width dimension of the paper roll and the stop position may be appropriately changeable according to increase/decrease or change in the kind of width dimension of the paper roll that is processed.

Based on the input by step S402, the rotational phase value (target value) of the input shaft of the absolute rotary encoder 25 when the arms 3*a*, 3*b* or 4*a*, 4*b* of the support arm pair 3 or 4 subject to presetting have moved from the reference position to the input-set certain stop position is calculated by the arm stop position control unit 2 (step S410).

Moreover, accompanying execution of step S402, automatic verification of whether conditions enabling presetting are present or not is performed (step S403). In detail, at least the following six items are automatically verified, namely that:

(1) the rotational phase of the rotating shaft 5 is such that either of the support arm pair 3 or 4 is at the paper roll mounting position;

(2) the support arm pair 3 or 4 at the paper roll mounting position and subject to presetting is not mounted with a paper roll;

(3) electrical connection to the absolute rotary encoder 25 is normal;

(4) the input-set stop position of the arms 3*a*, 3*b* or 4*a*, 4*b* is in a movable range of the arms 3*a*, 3*b* or 4*a*, 4*b;*

(5) the arm stop position control unit 2 is not in origin recording mode; and (6) there is no electrical connection path abnormality of the female screw driving motor 16 associated with the arms 3*a*, 3*b* or 4*a*, 4*b* of the support arm pair 3 or 4 at the paper roll mounting position and subject to presetting. Further, when an unsatisfied item is found among these items, an indication to that effect is output by an appropriate means, and steps following step S403 become unexecutable.

Subsequently, a "start" button of the graphic panel 2*a* is pressed (step S404), and a presetting start signal is outputted (step S405). When the presetting start signal is outputted, data related to the position at that time of each of the arms 3*a*, 3*b* or 4*a*, 4*b* subject to presetting that is downloaded to the arm stop position control unit 2, that is, the rotational phase value at that time (current value) of the input shaft of the absolute rotary encoders 25 associated with each of the arms 3*a*, 3*b* or 4*a*, 4*b* subject to presetting, and the rotational phase value (target value) of the input shaft of the absolute rotary encoders 25 calculated by the arm stop position control unit 2, are compared (step S411). Note that, when performing this comparison, to prevent occurrence of hunting in the stop control to the certain stop position of the arms 3*a*, 3*b* or 4*a*, 4*b* of the support arm pair 3 or 4 subject to presetting, this target value is assigned a range $\pm\alpha$ sufficient to prevent trouble occurring in the paper roll mounting.

In said comparison, when the current value is not included in the target value having the aforementioned range, the brake 26 associated with the arms 3*a*, 3*b* or 4*a*, 4*b* of the support arm pair 3 or 4 subject to presetting is switched off, and the similarly-associated female screw driving motor 16 operates causing the drive gear 15 attached to the output shaft of the female screw driving motor 16 to rotate. This rotation of the drive gear 15 causes the driven gear 14 and the gear 24 which are engaged with the drive gear 15 to be rotated. Rotation of the driven gear 14 causes the female screw member 13 which is configured in an integrated manner with the driven gear 14 to be rotated, and to be moved by thread advancement along the male screw member 18 to which the female screw member 13 is thread-connected. As a result, one of the arms 3*a*, 3*b*, 4*a*, 4*b* to which the female screw member 13 is fitted rotatably and so as not to move in the axis direction is moved along the male screw member 18 together with the female screw member 13. When the current value is smaller than the target value having the range, the arms 3*a*, 3*b* or 4*a*, 4*b* of the support arm pair 3 or 4 subject to presetting move in a direction that broadens the spacing of the support arm pair 3 or 4, and when the current value is larger than the target value having the range, the arms 3*a*, 3*b* or 4*a*, 4*b* of the support arm pair 3 or 4 subject to presetting move in a direction that narrows the spacing of the support arm pair 3 or 4 (step S412).

Moreover, rotation of the gear 24 causes the input shaft of the absolute rotary encoder 25 to rotate, whereby the rotational phase value of the absolute rotary encoder 25, that is, the current value, changes. This changing current value is compared with the target value having the range (step S413), and steps S412 and S413 repeated until the current value is included in the target value having the range. At the point in time when the current value is included in a range of the target value having the range, the arms 3*a*, 3*b* or 4*a*, 4*b* of the support arm pair 3 or 4 subject to presetting are regarded as having arrived at the set stop position (step S501), the brake 26 associated with said arms 3*a*, 3*b* or 4*a*, 4*b* of the support arm pair 3 or 4 subject to presetting is switched on, and the similarly-associated female screw driving motor 16 is stopped (step S502). Furthermore, after a certain time has passed, a re-verification is performed of whether the current value of the arms 3*a*, 3*b* or 4*a*, 4*b* of the support arm pair 3 or 4 subject to presetting is included in the target value having the range (step S503). This verification is performed in view of a marginal delay in reading-in of the rotational phase value of the input shaft of the absolute rotary encoder 25. In this re-verification, when the current value of the arms 3*a*, 3*b* or 4*a*, 4*b* of the support arm pair 3 or 4 subject to presetting deviates from the range of the target value having the range, steps S412, S413, S501, S502, and S503 are repeated again. In the re-verification, when the current value of the arms 3*a*, 3*b* or 4*a*, 4*b* of the support arm pair 3 or 4 subject to presetting is included in the range of the target value having the range, the arms 3*a*, 3*b* or 4*a*, 4*b* of the support arm pair 3 or 4 subject to presetting are regarded as having definitely reached the set stop position (step S504), the presetting terminates normally (step S505), and the stop position of the arms 3*a*, 3*b* or 4*a*, 4*b* of the support arm pair 3 or 4 subject to presetting is displayed on the graphic panel 2*a* (step S506), thereby completing the presetting.

On the other hand, in the comparison of step S411, when the current value is included in the range of the target value having the range, the arms 3*a*, 3*b* or 4*a*, 4*b* of the support arm pair 3 or 4 subject to presetting are regarded as having definitely reached the set stop position (step S504), and, similarly to as described previously, the presetting terminates normally (step S505), and the stop position of the arms 3*a*, 3*b* or 4*a*, 4*b* of the support arm pair 3 or 4 subject to presetting is displayed on the graphic panel 2*a* (step S506), thereby completing the presetting.

Note that when some kind of abnormality occurs during this presetting activation, for example, when the presetting has not terminated normally within a previously set time or when the rotational phase value of the input shaft of the absolute rotary encoder 25 exceeds a previously set value, a display informing of the previously set abnormality is outputted on the graphic panel 2*a* and the presetting activation terminates at the point in time when the abnormality occurred.

In addition, in the case of moving a paper roll in the axis direction after the presetting is completed as previously described and the paper roll is mounted on the support arm pair 3 or 4 at the support 23 which is the paper roll supporting means in the arms 3*a*, 3*b* or 4*a*, 4*b* of the support arm pair 3 or 4, the male screw driving motor 22 is activated to rotate the male screw member 18. As a result, the two female screw members 13, 13 associated with the arms 3*a*, 3*b* or the two female screw members 13, 13 associated with the arms 4*a*, 4*b* are moved in unison by the same distance in the same direction with respect to the male screw member 18, whereby the arms 3*a*, 3*b* or 4*a*, 4*b* associated with each of the female screw members 13 are moved in unison by the same distance in the same direction with respect to the male screw member 18.

Preferred embodiments of the present invention have thus been described, but the technical scope of the present invention is not limited to the scope of description in the above embodiments. Various changes or improvements can be made to the above embodiments. It is clear from the descriptions in the claims that embodiments including such changes or improvements can also be included in the technical scope of the present invention.

What is claimed is:

1. A paper roll mounting device comprising:

a rotating shaft rotatably supported by two frames that face each other at a distance;

a plurality of pairs of arms attached to the rotating shaft so as to face each other in an axis direction of the rotating shaft and configured to be individually movable in the axis direction;

paper roll supporting means provided to an extremity of each of the arms so as to face each other in the axis direction;

a male screw member supported parallel to the rotating shaft by the rotating shaft, and configured to penetrate both arms of one of the pairs of arms that face each other in the axis direction;

a female screw member provided rotatably to each of the facing arms and coupled to the rotating shaft and configured to be thread-connected to the male screw member; and a female screw driving motor configured to individually rotary-drive the female screw member, wherein the paper roll mounting device, configured to enable a paper roll to be supported by the paper roll supporting means provided to each of the arms of one of the pairs of arms by rotary-driving the female screw member to individually move each of the arms in a direction parallel to the rotating shaft, is provided with:

a female screw rotation amount signal output means provided to output a rotation amount signal corresponding to a rotation amount of the respective female screw member, individually on a female screw member basis, in response to rotation of the female screw member; and an arm stop position control unit configured to enable setting of a reference position for each of the arms, and, when changing a position of each of the arms in the axis direction of the rotating shaft, to enable input designation of a stop position of each of the arms, and to detect a current position of the arms with respect to the reference position by calculating a movement amount of the arms based on the rotation amount signal, and thereby move each of the arms to the designated stop position and cause each of the arms to stop at the designated stop position, thus making each of the arms stoppable at a desired position in the direction parallel to the rotating shaft.

* * * * *